US008555693B2

(12) United States Patent
Brochheuser et al.

(10) Patent No.: US 8,555,693 B2
(45) Date of Patent: Oct. 15, 2013

(54) METHOD FOR FORMING HOLLOW PROFILES

(75) Inventors: Ulrich Brochheuser, Neunkirchen (DE); Andreas Gehrke, Siegburg (DE)

(73) Assignee: GKN Driveline International GmbH, Lohmar (DE)

( * ) Notice: Subject to any disclaimer, the term of this patent is extended or adjusted under 35 U.S.C. 154(b) by 535 days.

(21) Appl. No.: 12/442,473

(22) PCT Filed: Sep. 22, 2006

(86) PCT No.: PCT/EP2006/009197

§ 371 (c)(1), (2), (4) Date: Apr. 17, 2009

(87) PCT Pub. No.: WO2008/034456

PCT Pub. Date: Mar. 27, 2008

(65) Prior Publication Data

US 2009/0305797 A1 Dec. 10, 2009

(51) Int. Cl.
*B21C 37/30* (2006.01)

(52) U.S. Cl.
USPC ..... 72/370.24; 72/283; 72/370.25

(58) Field of Classification Search
USPC ..... 72/264–266, 41, 283, 370.01, 370.02, 72/370.23, 370.24, 370.25, 363, 359, 427, 72/344, 347
See application file for complete search history.

(56) References Cited

U.S. PATENT DOCUMENTS

| | | | | |
|---|---|---|---|---|
| 2,549,705 | A * | 4/1951 | Offutt | 72/347 |
| 3,587,281 | A * | 6/1971 | Lemelson | 72/265 |
| 3,596,491 | A * | 8/1971 | Cress et al. | 72/283 |
| 3,885,622 | A * | 5/1975 | McLain | 29/DIG. 23 |
| 3,977,227 | A * | 8/1976 | Noble | 72/283 |
| 4,622,840 | A | 11/1986 | Diffenderfer et al. | |
| 5,076,084 | A * | 12/1991 | Furugen | 72/41 |
| 5,105,644 | A | 4/1992 | Simon | |
| 6,837,091 | B2 | 1/2005 | Brochheuser et al. | |
| 7,062,948 | B2 * | 6/2006 | Beagle | 72/370.02 |
| 2004/0112113 | A1 * | 6/2004 | Beagle | 72/370.01 |
| 2004/0267050 | A1 * | 12/2004 | DeCourcy et al. | 562/600 |
| 2005/0043104 | A1 * | 2/2005 | Dine et al. | 464/181 |

FOREIGN PATENT DOCUMENTS

| | | | |
|---|---|---|---|
| DE | 101 18 032 | A1 | 10/2002 |
| DE | 20122516 | U1 | 12/2005 |
| GB | 1 071 456 | A | 6/1967 |
| JP | 50001957 | A | 1/1975 |

(Continued)

OTHER PUBLICATIONS

First Office Action from Chinese Patent Application No. 200680055870.2 dated Jun. 7, 2010.

(Continued)

*Primary Examiner* — Dana Ross
*Assistant Examiner* — Pradeep C Battula
(74) *Attorney, Agent, or Firm* — Rader, Fishman & Grauer, PLLC

(57) ABSTRACT

A method for forming hollow profiles is disclosed. In one exemplary method, a hollow profile is guided through a die in a processing direction and fixed by a mandrel such that at the die, the hollow profile has a material flow velocity in this processing direction (2), in which the method the mandrel has a drawing velocity in the processing direction that is greater than the material flow velocity.

9 Claims, 3 Drawing Sheets

(56) References Cited

FOREIGN PATENT DOCUMENTS

| | | | |
|---|---|---|---|
| JP | 2137614 | A | 5/1990 |
| JP | 8109918 | A | 4/1996 |
| JP | 2002-113545 | A | 4/2002 |
| SU | 504574 | A | 2/1976 |

OTHER PUBLICATIONS

International Search Report PCT/EP2006/009197 dated May 9, 2007.
English Abstract of SU504574.
English Language Abstract of JP 8109918.

* cited by examiner

METHOD FOR FORMING HOLLOW PROFILES

CROSS-REFERENCE TO RELATED APPLICATIONS

This application is a National Stage application which claims the benefit of International Application No. PCT/EP2006/009197 filed Sep. 22, 2006 which is hereby incorporated by reference in its entirety.

BACKGROUND

The present invention relates to a method for forming hollow profiles, in particular hollow shafts in the automotive industry, whereby the hollow profile is guided through a die in a processing direction and fixed by a mandrel.

A multitude of different methods are already in use in the automotive industry for forming hollow profiles. Hollow profiles regularly have a tubular design and are provided with a structure or modified in terms of their diameter within a subsequent forming operation. These hollow profiles are particularly used as hollow shafts in motor vehicles.

It is routinely the case that specific safety criteria have to be complied with when forming such hollow profiles, especially if they are exposed during use to defined static and dynamic forces and to high torque loading. For instance, it is necessary, on the one hand, to avoid cracks forming in the material during the forming operation. Therefore, the degree of deformation during such a forming process is limited. On the other hand, there is a continuing trend for such motor vehicle components to have a particularly lightweight design, resulting in a wish for thin-walled hollow profiles. However, especially when the method used for forming hollow profiles is that of so-called forward extrusion, problems arise with thin-walled hollow profiles in terms of the transmission of force required to guide the hollow profile through a corresponding die with a high degree of deformation. In addition, depending on the particular choice of material, it is in some cases necessary to carry out complicated lubricating processes during the forming operation and/or special (thermal and/or surface-specific) pretreatments of the hollow profiles before a forming step or between a number of partial forming steps.

Taking this as a staring point, it is desired to use a method for forming hollow profiles that, while allowing a wide variety of materials for the hollow profiles, in particular without complicated pretreatment of the hollow profiles, makes it possible to achieve an increased degree of deformation even when using thin-walled profiles. It is also desired to lead to a particularly high processing accuracy, with the result that, for example, better shape and/or positional tolerances with respect to the dimensions of the hollow profiles can be maintained. Finally, it is also desired to specify particularly advantageous possible uses for hollow profiles produced in this way.

BRIEF SUMMARY

A method for forming hollow profiles is disclosed. In one exemplary method, a hollow profile is guided through a die in a processing direction and fixed by a mandrel such that at the die, the hollow profile has a material flow velocity in this processing direction (2), in which the method the mandrel has a drawing velocity in the processing direction that is greater than the material flow velocity. Further embodiments of the method are provided in the patent claims. Features listed individually in the patent claims can be combined with one another in any desired, technologically meaningful way and demonstrate further embodiments of the disclosure. The features are, moreover, further explained or specified in the description, so that advantageous developments of the disclosure are also demonstrated here.

The exemplary method thus particularly concerns a forward extrusion process in which a pressing force produced on the hollow profile by a ram and intended to force the profile through the die is assisted by a moving mandrel, which particularly fixes the hollow profile radially inwardly. The phrase "forward extrusion" means forcing a hollow profile through a die, with the direction of the material flow substantially corresponding to the processing direction. Here, the hollow profile in the die experiences a plastic deformation. A die is particularly understood to mean a shaping tool orifice. In the embodiment of the exemplary method, which takes the form of a hollow forward extrusion process, the hollow profile has a substantially tubular structure in the processing region, while the shaping tool orifice is formed by a gap between the die and the ram.

While it was previously the case that the forming force which can be transmitted to the hollow profile was applied by means of a ram via, for example, the end face of the hollow profile, it is now proposed that the force transmission is additionally assisted by a moving mandrel. By using the ram to apply a force, the material of the hollow profile flows with a definable material flow velocity in the region of the die, it previously being the case that considerable frictional forces (acting counter to the processing direction) between the (fixed) mandrel and the flowing material of the hollow profile also had to be overcome. In the exemplary embodiment of the present disclosure, the mandrel is moved in the processing direction, this taking place at a drawing velocity which is greater than the material flow velocity. Thus, force is also transmitted via the friction to the hollow profile which is to be processed. Consequently, a second force transmission point for a force which assists the forming operation is obtained in the processing direction.

A major advantage of this method is that, especially in the case of thin-walled hollow profiles, the forming force is conventionally limited by the buckling load of the hollow profile, which routinely means that only small degrees of deformation can be obtained. By virtue of superimposed compressive stresses in the forming operation according to the method proposed here, the risk of crack formation has been considerably reduced.

According to one development of the method, the hollow profile has a wall thickness of at most 6 mm. The method has a particular application, especially in relation to the automotive sector, to hollow profiles having a wall thickness of about 1.5 mm to 4 mm. In principle, a large number of different materials can be used here, with steel materials and aluminum materials being preferred.

In addition, it is also proposed that a change in a diameter of the hollow profile may be brought about as it is guided through the die. Preference is given in this respect to a reduction in the diameter.

Alternatively and/or in combination to this, it may be advantageous for a structure to be produced in at least one subregion of the hollow profile as it is guided through the die. The formation of a "structure" is accompanied in particular by a change in cross-sectional shape of the hollow profile. Thus, for example, elevations and/or depressions can be formed in the circumferential direction of the hollow profile (in certain regions or over the entire circumference), with these preferably accompanied by a simultaneous change in diameter.

It has been found that, as a result of the concomitantly moving mandrel, it was possible to maintain particularly high tolerance requirements in terms of the dimensional accuracy or the roundness of reduced-diameter hollow profiles and/or the configuration of structured hollow shafts.

Contrary to the widespread view that the forward extrusion process requires specially pretreated hollow profiles to ensure a high degree of deformation in mass production, it is also proposed here to carry out the method according to the disclosure with a hollow profile having a prestrengthened material. By this it is meant in particular that the hollow profile has, for example, already been cold-worked beforehand, with the cold work hardening not being removed again by a subsequent thermal treatment. Such cold-worked hollow profiles can also be (further) formed in a dimensionally accurate manner using the method proposed here.

In addition, the hollow profile can also be supplied with a weld seam. This concerns the case, for example, where a tube-like hollow profile, which serves as a semifinished product for the method proposed here, has been bent from a metal plate and subsequently welded together. Such a hollow profile, which, for example, has a weld seam in the processing direction, can also be formed using the method proposed here, with high shape tolerances being ensured.

According to one development of the method, the ambient temperature does not exceed 300° C. during the forming operation. In particular, the ambient temperature does not exceed 200° C. The ambient temperature particularly means the temperature of the tool or the workpiece. What this is particularly intended to express is that the method is not accompanied by a prior and/or simultaneous heat treatment. This enables the production costs for such hollow profiles to be significantly reduced, with shorter cycle times being possible at the same time.

In certain applications, it may also be advantageous to vary at least the material flow velocity or the drawing velocity in the processing direction during the processing of the hollow profile. Here, it is also possible in principle for a simultaneous and/or time-staggered variation of the material flow velocity and the drawing velocity to be performed. Thus, for example, material inhomogeneities or other parameters locally influencing the forming operation can be taken into account.

According to one development of the method, the forming operation is carried out dry. A "dry" forming operation particularly results when a simultaneous supply of lubricant is dispensed with. Therefore, no lubricants which influence the friction between the die and tube profile or between the hollow profile and mandrel are added in the forming region during the forming process. Such a method is particularly advantageous in terms of lower production costs and caring for the environment.

If appropriate, however, a preparatory lubricating operation can also be performed. For this purpose, the hollow profile can, for example, be dipped in a lubricant or sprayed before the forming operation, with the result that a lubricating film is produced on the surface of the hollow profile. The thus pretreated hollow profile is subsequently "dry"-formed.

Furthermore, there is also proposed at this point a motor vehicle component which comprises at least two hollow profiles, wherein at least one hollow profile is produced by a method described according to the disclosure, in which components of the two hollow profiles are arranged concentrically, at least in one portion.

Such a double hollow profile makes it possible, particularly in the manufacture of hollow shafts or torque transmitters in the motor vehicle industry, to produce a kind of predetermined breaking point such that when, for example, a very high force acts in the direction of the hollow shaft, any vertical deflection within the motor vehicle is avoided and the hollow profiles in this case slide one inside the other or interrupt the torque transmission. Since, however, the two hollow profiles have to transmit a considerable torque during a customary use, it is desired to have a very high dimensional accuracy or a very intimate contact between the two hollow profiles in the at least one portion.

For this reason, too, it is proposed that the hollow profiles may form an interlocking structure in the portion. What is particularly meant here is a structure extending in the circumferential direction that is built up uniformly and composed of repeating formations comprising elevations and depressions. In such a case for both hollow profiles to be produced by the method described according to the disclosure, since this makes it possible to achieve particularly high dimensional accuracies, with the result that the flanks of the elevations or depressions arranged concentrically with respect to one another form a very large contact surface with one another and can accordingly transmit a considerable torque.

In one exemplary embodiment, the method described according to the disclosure produces a vehicle component in which the hollow profiles each have a wall thickness in the range from about 1.5 to 4 mm.

Finally, there is also proposed a motor vehicle comprising at least one motor vehicle component of the above-described type for the transmission of torque, since it allows a particularly dimensionally accurate and high-performance 5 component for the motor vehicle industry to be produced in a cost-effective manner.

BRIEF DESCRIPTION OF THE DRAWINGS

The disclosure and the technical field are illustrated in more detail below with reference to the figures. It should be pointed out that the figures show particularly exemplary design variants of the disclosure, but the disclosure is not limited thereto.

In the figures.

DETAILED DESCRIPTION

Figure 1:
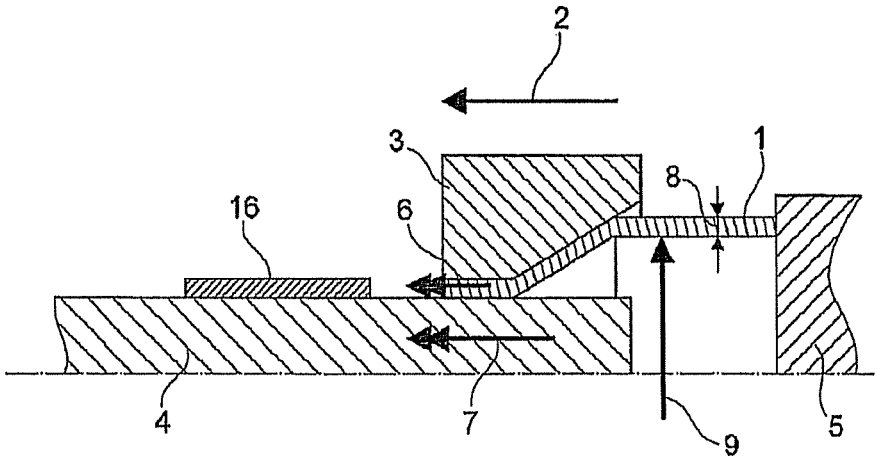
FIG. 1 schematically shows a first processing situation in one embodiment of the method, FIG. 2 schematically shows a second processing situation in a further example of the method, FIG. 3 schematically shows a design variant of a motor vehicle component comprising concentric hollow profiles, FIG. 4 schematically shows an exemplary area of application for such hollow profiles in a motor vehicle, and FIG. 5 schematically shows a flow diagram pertaining to a further design variant of the method.

FIG. 1 is intended to schematically describe the state such as can occur during a forming operation according to the disclosure on a tube-like hollow profile 1. The tool arrangement illustrated comprises a die 3, a ram 5, a mandrel 4 and an ejector 16. The die 3, which is outwardly positioned here with respect to the hollow profile 1, is designed to be fixed, and the hollow profile 1 is forced through the inner orifice of the die 3 (represented in half cross section) by means of the ram 5 bearing at the end face of the hollow profile 1. A forming operation on the hollow profile 1, which has a predetermined wall thickness 8, now takes place at the die 3 such that a reduction in the diameter 9 occurs.

To obtain a controlled forming operation, the mandrel 4 is arranged inside the die 3, namely concentrically with respect to orifice of the die 3, such that the die 3 and mandrel 4 form a gap through which the hollow profile 1 is forced. During the process, a material flow velocity 6 is thus established in the processing direction 2 that primarily initially results from the action of the ram 5 on the hollow profile 1. According to the disclosure, the mandrel 4 is now concomitantly moved in the processing direction 2 with a drawing velocity 7 which is greater than the material flow velocity 6. This is illustrated by the arrows depicted here. Since an increased drawing velocity 7 is present, a force is likewise transmitted in the processing point or in the gap between the die 3 and mandrel 4 by the sliding friction, with the result that the forming force which is transmitted via the ram 5 can be reduced or there results an increased total forming force overall. The total forming force ($FF_{total}$) here is obtained from the forming force (FF) of the ram 5 and the frictional forces (FrF) at the die 3 and mandrel 4 ($FF_{total}=FF_{ram}+FrF_{die}-FrF_{mandrel}$). Here, the frictional force of the mandrel 4 is, where appropriate, dependent on the lubricant used on the surface of the hollow profile 1.

Once the forming operation is complete, with for example only one subregion of the hollow profile having been formed, the hollow profile 1 can finally be removed from the tool arrangement again by means of an ejector 16 counter to the processing direction 2.

Figure 2:
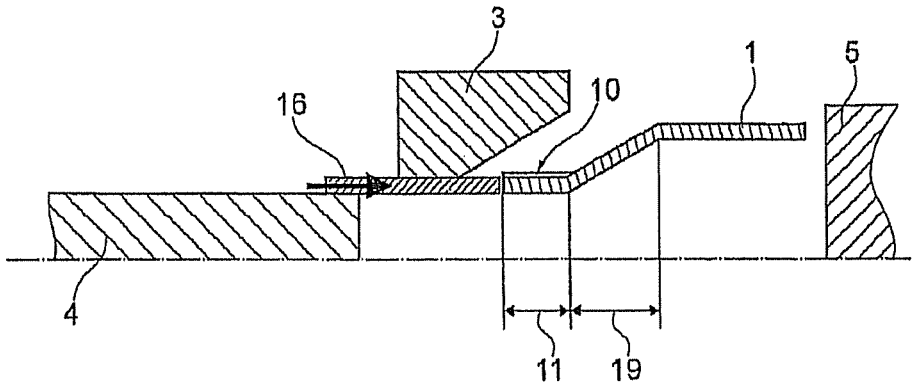

The last-mentioned method step in which the ejector 16 releases the hollow profile 1 again can be seen in FIG. 2. In the method situation illustrated here, the die 3 and mandrel 4 are no longer in engagement, but the ejector 16 removes the hollow profile 1. During the processing work which occurred beforehand, a forming operation on a subregion 11 was carried out in which a structure was generated. Here, this one subregion 11 is produced close to a (front) end of the tubular hollow profile 1. Adjoining this is created a widened portion in the form of a cone 19 which constitutes a transition region with respect to the original hollow profile 1.

Figure 3:
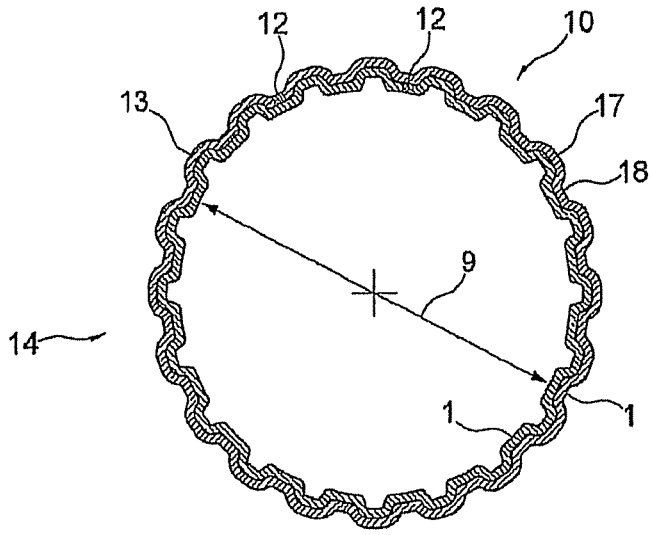

FIG. 3 shows a cross section through a motor vehicle component 13 which comprises two concentric hollow profiles 1. It can be seen that both hollow profiles 1 have been provided with a structure 10 comprising a multitude of elevations 17 and depressions 18. Both hollow profiles 1 can be produced by the method described according to the disclosure, although they have, for example, a different material and/or are constructed with a longitudinally oriented weld seam 12. In principle, it is possible for production purposes to use identical tube-like hollow profiles which, where appropriate, do not even differ from one another in terms of their diameter 9 prior to the forming processing operation. In the portion 14 illustrated here, the two hollow profiles are arranged concentrically with respect to one another in such a way that they are particularly well-suited for transmitting high torques, this being made possible mainly by the good fit accuracy or the especially good shape tolerances with respect to the structure 10.

Figure 4:
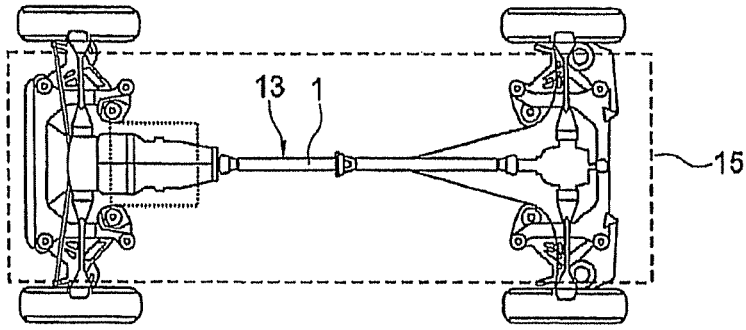

FIG. 4 is merely intended to illustrate by way of example the use of such a hollow profile 1 as a motor vehicle component 13 in a motor vehicle 15. Moreover, apart from being used as a propeller shaft, such a hollow profile can also be used as a shaft in other applications, for example in test stands, rolling machines, etc.

Figure 5:
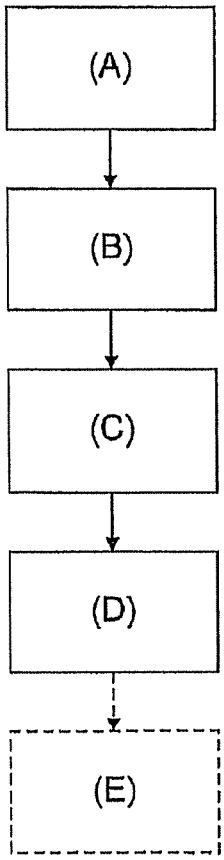

FIG. 5 is intended to schematically illustrate, in the manner of a flow diagram, a further example of the method according to the disclosure.

Step (A) here particularly comprises the provision of a hollow shaft. In this state, the hollow shaft can have cold work-hardened areas and/or even weld seams. In one exemplary embodiment, tube-like hollow shaft 1 has a wall thickness in the range from about 1.5 to 4 mm.

Within step (B), the hollow shaft is, for example, aligned or positioned in relation to a die, a ram and a mandrel. The mandrel here is advantageously in engagement with the hollow shaft such that it is possible, by means of the ram, for the hollow shaft to be fed exactly during the subsequent processing with a simultaneous drawing action.

Step (C) particularly comprises the hollow shaft being moved through the die by the ram force. Simultaneously or at different times, the mandrel is moved, within step (D), with a drawing velocity in the processing direction that is greater than the material flow velocity of the hollow shaft in the region of the die. Here, in order to increase the degree of deformation, use can also be made of lubricants which wet the contact region of the hollow shaft with respect to the die or with respect to the ram.

Method step (E), which is indicated here only by broken lines, comprises ejecting, if desired, the finish-processed hollow shaft from the tool arrangement.

To explain the method according to the disclosure, a processing example is illustrated below in which are shown, by way of example, the process parameters of such a forward extrusion process incorporating a controlled mandrel for the production of a slip-in tube:

Semifinished Product:

Material: E355 (ST 52-3)

Dimensions: Diameter 63.5 mm, Wall thickness 1.8 mm

Process:

Ram force: 200 kN

Material flow velocity: 40 mm/sec

Mandrel surface: Roughness Ra 0.3 mm, Material No. 1.2379

Mandrel velocity: 50 mm/sec

Die surface: Roughness Ra 0.03 mm, Material G20

Die dimensions: Angle 20°, Taper section 3 mm

Mandrel/Die gap: 1.7 mm

Lubrication: before the forming operation

Product:

Dimensions: Diameter 60 mm, Wall thickness 1.8 mm

Degree of deformation: locally very different owing to the geometry of the toothing.

The preceding description has been presented only to illustrate and describe exemplary embodiments of the methods of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method for forming hollow profiles, comprising; guiding a hollow profile through a die in a processing direction whereby the hollow profile is fixed by a mandrel such that at the die the hollow profile has a material flow velocity in the processing direction, in which the mandrel is moved in the processing direction at a velocity that is greater than the material flow velocity in a gap between the die and the mandrel, thereby creating a sliding friction force between the mandrel and the hollow profile, so that a second force transmission point for a force, which assists the forming operation in the processing direction, is obtained.

2. The method as claimed in claim 1, in which the hollow profile has a wall thickness of at most 6 millimeters.

3. The method as claimed in claim 1, in which a change in a diameter of the hollow profile occurs as the hollow profile is guided through the die.

4. The method as claimed in claim 1, in which a structure is produced in at least one subregion of the hollow profile as the hollow profile is guided through the die.

5. The method as claimed in claim 1, in which the hollow profile is supplied with a pre strengthened material.

6. The method as claimed in claim 1, in which the hollow profile is supplied with a weld seam.

7. The method as claimed in claim 1, in which an ambient temperature does not exceed 200° C. during the forming operation.

8. The method as claimed in claim 1, in which at least the material flow velocity or the drawing velocity in the processing direction is varied during processing of the hollow profile.

9. The method as claimed in claim 1, in which the forming operation is carried out dry.

* * * * *